US007262376B2

(12) United States Patent
Brojanac et al.

(10) Patent No.: US 7,262,376 B2
(45) Date of Patent: Aug. 28, 2007

(54) CIRCUIT BREAKER LOCKOUT DEVICE

(75) Inventors: Michael Brojanac, Jackson, WI (US); Scott Kalous, Kenosha, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 11/393,617

(22) Filed: Mar. 30, 2006

(65) Prior Publication Data

US 2006/0266631 A1 Nov. 30, 2006

Related U.S. Application Data

(60) Provisional application No. 60/594,333, filed on Mar. 30, 2005.

(51) Int. Cl.
*H01H 9/28* (2006.01)

(52) U.S. Cl. ..... 200/43.14; 200/43.15

(58) Field of Classification Search ..... 200/43.01, 200/43.11, 43.14–43.16, 43.19, 43.21, 43.22, 200/334

See application file for complete search history.

(56) References Cited

U.S. PATENT DOCUMENTS 4,347,412 A * 8/1982 Mihara et al. ..... 200/43.15
4,704,504 A * 11/1987 Jones et al. ..... 200/43.18
5,079,390 A * 1/1992 Costanzo et al. ..... 200/43.14
5,147,991 A * 9/1992 Jordan, Sr. ..... 200/43.14
5,300,740 A * 4/1994 Benda ..... 200/43.14
5,500,495 A 3/1996 Benda et al.
5,732,815 A 3/1998 Brouwer
6,617,532 B1 * 9/2003 Turek ..... 200/43.14
6,696,651 B1 * 2/2004 Koopmeiners et al. .. 200/43.14
6,727,441 B2 * 4/2004 Benda ..... 200/43.15

* cited by examiner

*Primary Examiner*—Michael A Friedhofer
(74) *Attorney, Agent, or Firm*—Calfee, Halter & Griswold, LLP

(57) ABSTRACT

A lockout device for securing a toggle switch. The lockout device includes a body, a first clamping surface, a second clamping surface, and a cam. The first clamping surface and the second clamping surface are moveably coupled to the body and are positioned to define a slot for accommodating the toggle switch. The cam is rotateably coupled to the body. When the cam is rotated in a first direction, the cam moves the first clamping surface towards the second clamping surface.

31 Claims, 20 Drawing Sheets

CIRCUIT BREAKER LOCKOUT DEVICE

CROSS-REFERENCE TO RELATED APPLICATIONS

This non-provisional application claims the benefit of U.S. Provisional Patent Application No. 60/594,333, entitled "Circuit Breaker Lockout Device," filed Mar. 30, 2005, which is hereby incorporated in its entirety.

FIELD OF THE INVENTION

This invention relates generally to lockout devices and specifically to lockout devices for securing toggle switches on circuit breakers.

BACKGROUND OF THE INVENTION

Circuit breakers and other electrical switches are in widespread use in a variety of commercial and residential settings. These switches may control potentially dangerous electrical currents. Consequently, a concern in the art has developed over accidental or unauthorized manipulation of these switches. One example of such concern is the manipulation of switches controlling power to industrial equipment. Another concern is the interruption of an in-process industrial operation.

OSHA Standard 29 CFR § 1910.147 requires energy lockout or tag-out procedures for the servicing and maintenance of machines and equipment in which the unexpected energization or start up of the machines or equipment could cause injury to employees. One step required in such a lockout procedure is to place the circuit feeding power to the equipment in the "off" position. To keep the circuit in an "off" position a circuit breaker lockout device can be attached to the breaker. Many circuit breaker lockout devices attach to the toggle switch of the breaker in such a way that prevents the toggle switch from being turned to the "on" position.

There are no established standards for circuit breaker toggle switches in the United States. They vary greatly in width, thickness and height even along one manufacturer's product line. Some have holes in the side which may vary in size and location depending on the manufacturer. Due to the electrical and heat resistance required, the toggle switches are typically constructed of a plastic that has a hardness. The toggle switch profiles also tend to be tapered or curved which makes gripping them very difficult.

Most prior art devices also do not work well on most breakers or only are designated for use on a very select type of breaker. Many prior art devices that are designed to use a lock to secure the lockout device can be removed with the lock still attached, while others allow the breaker to be turned to the "on" position even with the device attached.

There remains a need in the art for a circuit breaker lockout device that can be adapted for use with a wide variety of switch sizes and types, is easy to adapt to a specific switch, and can grasp switches of various shape.

SUMMARY OF THE INVENTION

This invention is directed to apparatus and methods for locking toggle switches. The apparatus and methods are designed such that a device can clamp onto a toggle switch and prevent the toggle switch from being moved from a fixed position, either from an "on" to an "off" position or from an "off" to an "on" position. Optionally, the device can be arranged to accommodate a lock on the device to secure the device from being removed from the toggle switch by an unauthorized person.

An embodiment of the invention provides for a lockout device. The lockout device includes a body, a first clamping surface, a second clamping surface, and a cam. The first clamping surface and the second clamping surface are moveably coupled to the body and are positioned to define a slot for accommodating a toggle switch. The cam is rotateably coupled to the body. When the cam is rotated in a first direction, the cam moves the first clamping surface towards the second clamping surface.

DESCRIPTION OF THE DRAWINGS

In the accompanying drawings, which are incorporated in and constitute a part of this specification, embodiments of the invention are illustrated, which, together with a general description of the invention given above, and the detailed description given below serve to illustrate the principles of this invention. The drawings and detailed description are not intended to and do not limit the scope of the invention or the claims in any way. Instead, the drawings and detailed description only describe embodiments of the invention and other embodiments of the invention not described are encompassed by the claims.

DETAILED DESCRIPTION

Figure 1:
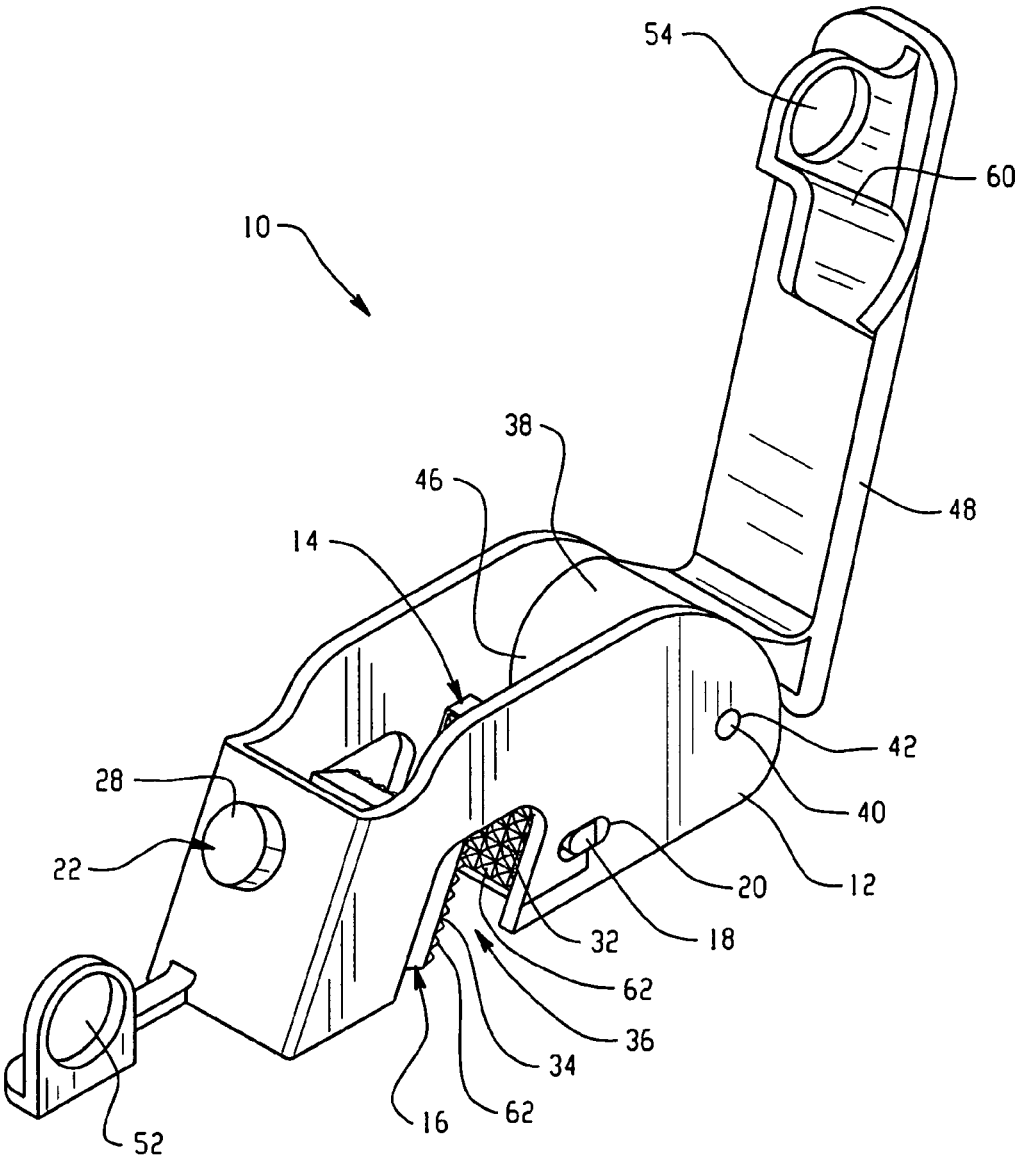
FIG. 1 is a perspective view of a lockout device constructed in accordance with the present invention.
Figure 2:
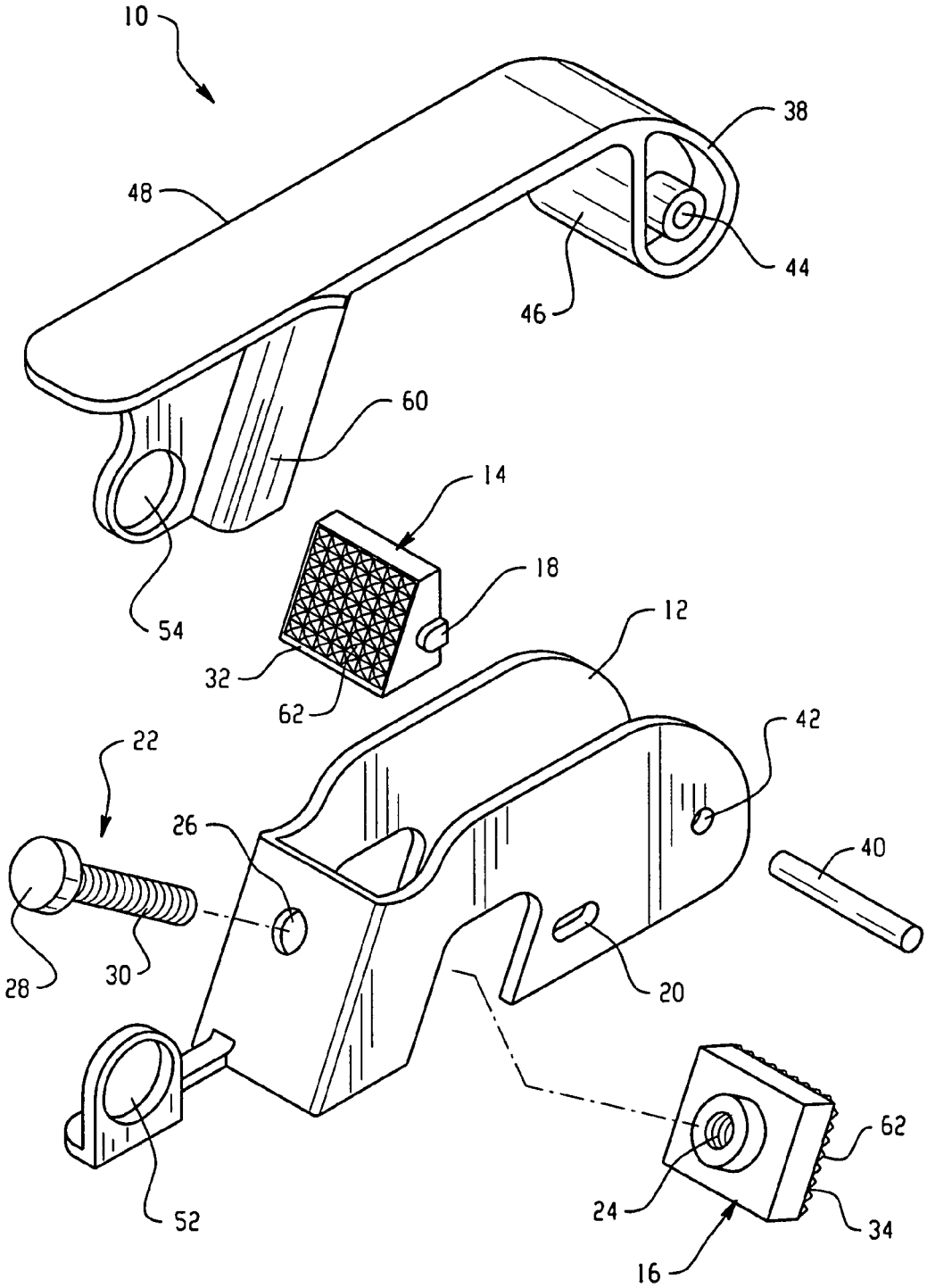
FIG. 2 is an exploded view of the lockout device of FIG. 1.

The Detailed Description of the Invention merely describes preferred embodiments of the invention and is not intended to limit the scope of the claims in any way. Indeed, the invention as described by the specification and claims is broader than and unlimited by the preferred embodiments, and the terms in the claims have their full ordinary meaning.

As described herein, apparatus and methods can be designed for securing a toggle switch of a circuit breaker in a desired position. A toggle switch typically has two positions, an "on" position that allows electrical power to pass through a circuit and an "off" position that does not allow electrical power to pass through a circuit. Depending on the circumstances, the desired position of a toggle switch may be either the "on" position or the "off" position. For example, if a machine performs a critical function, such as a respirator providing air to a comatose patient in a hospital, the toggle switch of the circuit providing power to the respirator is preferably secured in the "on" position. Conversely, if a manufacturing machine is undergoing manual maintenance, the toggle switch of the circuit providing power to the machine is preferably secured in the "off" position to protect maintenance workers from injuries.

FIGS. 1 through 4 illustrate an exemplary embodiment of a circuit breaker lockout device 10 in accordance with the present invention. The lockout device 10 includes a body 12, a first clamping member 14 coupled to the body 12, and a second clamping member 16 coupled to the body 12. The first clamping member 14 includes two tabs 18 (only one shown in FIGS. 1, 2, and 4) and the body includes two slots 20 (best seen in FIG. 2), which are designed to accept the tabs 18. The first clamping member 14 is coupled to the body 12 by the positioning of the two tabs 18 into the two slots 20. The slots 20 are sized to be larger than the tabs 18 such that the tabs 18 can slide along the slots 20. This arrangement makes the first clamping member 14 movable or adjustable with respect to the body 12. Although this exemplary embodiment is described with a pair of tabs 18 and a pair of slots 20, it will be understood that any number of slots or tabs can be utilized. In addition, arrangements other than slots and tabs can be utilized and are included in this disclosure, provided the arrangement couples a first clamping member to a body and allows for the first clamping member to move with respect to the body.

The second clamping member 16 is coupled to the body 12 by a thumbscrew 22. The second clamping member 16 includes a threaded aperture 24 and the body 12 includes a thumbscrew aperture 26. The thumbscrew 22 includes a knob 28 attached to a threaded rod 30. The threaded rod 30 portion of the thumbscrew 22 passes through the thumbscrew aperture 26 of the body 12 and is threaded into the threaded aperture 24 of the second clamping member 16. This arrangement fixes the position of the thumbscrew 22 with respect to the body 12, but allows for the thumbscrew 22 to rotate about its longitudinal axis. As the thumbscrew 22 rotates, the interaction of the threaded rod 30 and the threaded aperture 26 changes the position of the second clamping member 16 with respect to the body 12. Thus, the manual rotation or turning of the knob 28 moves or adjusts the second clamping member 16 with respect to the body 12.

Figure 3A:
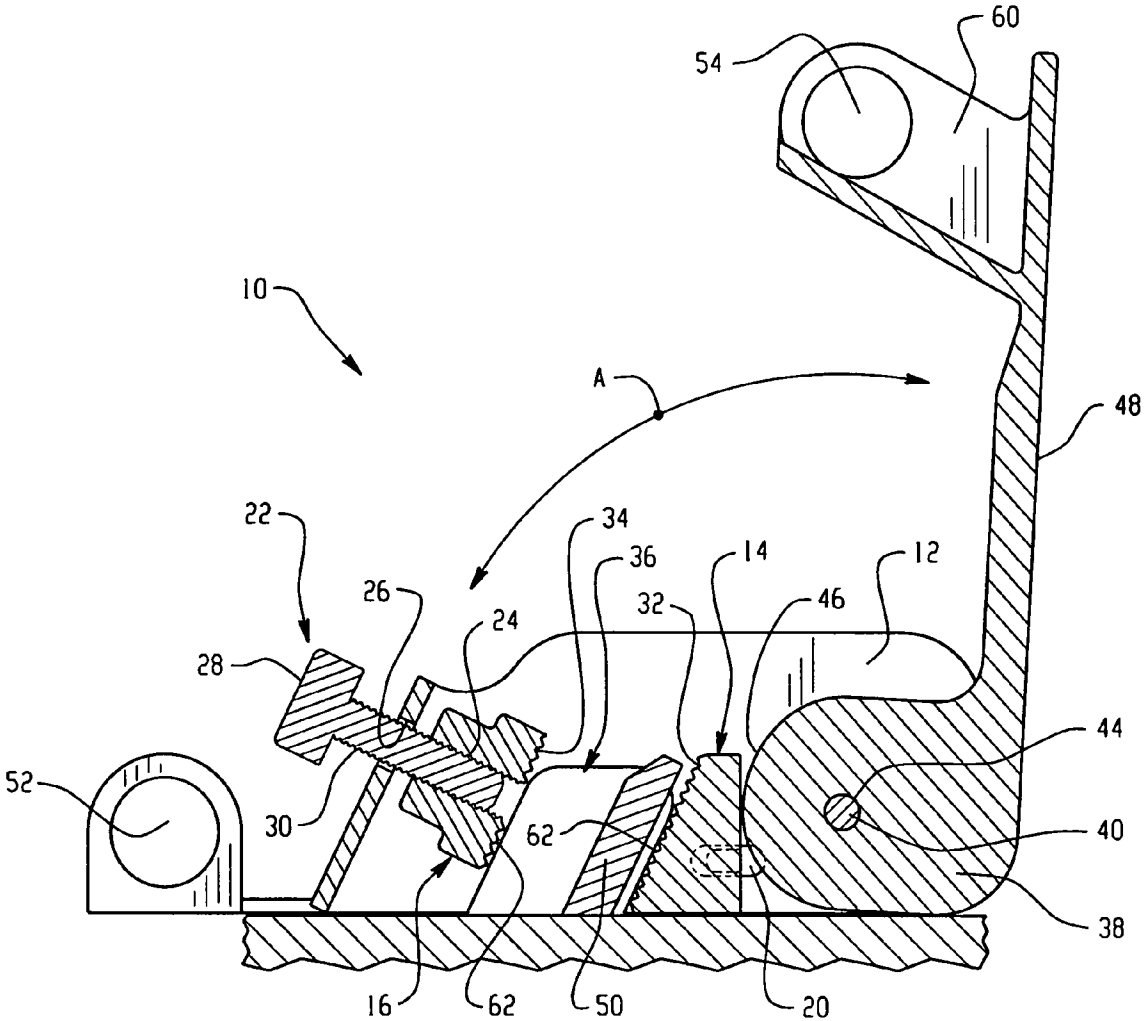
FIG. 3A is a cross-sectional view of the lockout device of FIG. 1 in an open position, wherein a toggle switch is positioned between the clamping surfaces of the device.
Figure 3B:
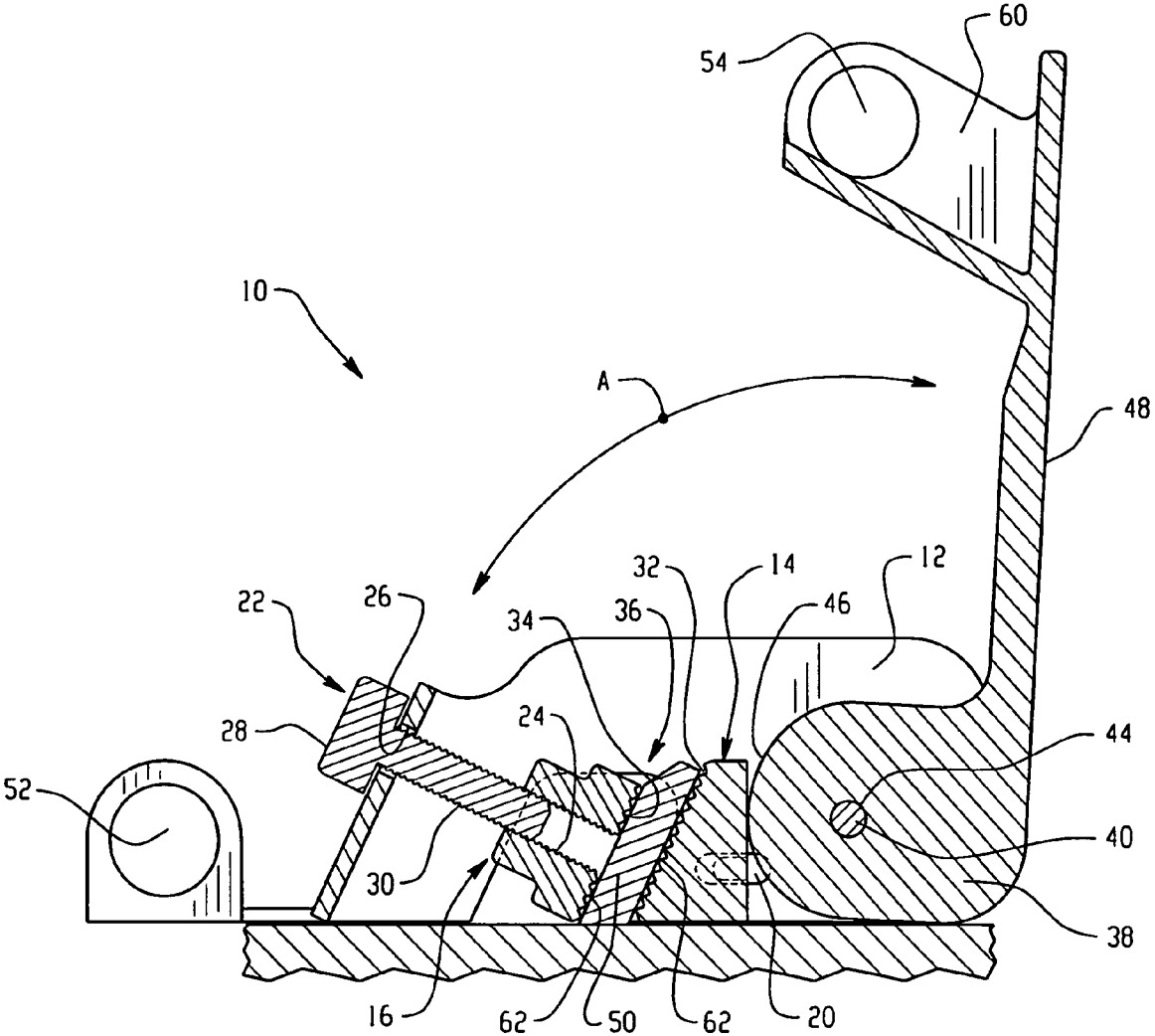
FIG. 3B is a cross-sectional view of the lockout device of FIG. 1 in an open position, wherein the toggle switch is clamped between the clamping surfaces of the device.
Figure 3C:
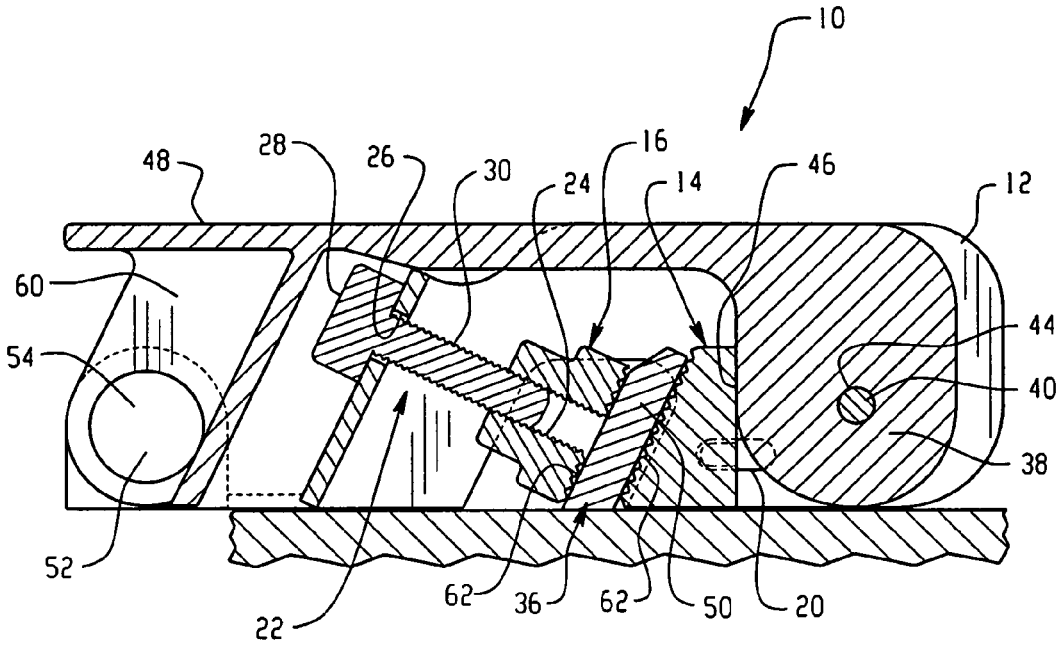
FIG. 3C is a cross-sectional view of the lockout device of FIG. 1 in the closed position, wherein a toggle switch is clamped between the clamping surfaces of the device.

The first clamping member 14 includes a first clamping surface 32 and the second clamping member 16 includes a second clamping surface 34. As best seen in FIGS. 3A, 3B, and 3C, when the clamping members 14 and 16 are coupled to the body 12, the first clamping surface 32 and the second clamping surface 34 face one another and are positioned to be generally parallel. As the first clamping member 14 is moved or adjusted with respect to the body 12, the first clamping surface 32 remains generally parallel to the second clamping surface 34. Similarly, as the second clamping member 16 is moved or adjusted with respect to the body 12, the second clamping surface 34 remains generally parallel to the first clamping surface 32.

As discussed, the second clamping member 16 is moved or adjusted relative to the body 12 through the manipulation of the thumbscrew 22. As the thumbscrew 22 is rotated or turned in a first direction, the second clamping surface 34 moves towards the first clamping surface 32 and as the thumbscrew 22 is rotated or turned in a second direction, the second clamping surface 34 moves away from the first clamping surface 32. The positioning of the first and second clamping surfaces 32 and 34 forms a gap or slot 36 between the surfaces 32 and 34. The movement of the second clamping surface 34 relative to the first clamping surface 32 increases or decreases this gap 36.

The lockout device 10 also includes a cam member 38. The cam member 38 is rotateably coupled to the body with a pivot pin 40 that passes through a pair of holes 42 in the body 12 and a hole 44 in the cam member 38. The cam member 38 includes a camming surface 46 that is located proximate to the first clamping member 14. A lever or handle 48 is coupled to the cam member 38 to facilitate the manual rotation of the cam member 38. As seen FIGS. 3A, 3B, and 3C, the lever 48 is moveable along a rotational path A between an open position (as seen in FIGS. 3A and 3B) and a closed position (as seen in FIG. 3C). The cam member 38 and the first clamping member 14 are arranged such that when the lever 48 rotates from the open position to the closed position, the camming surface 46 moves the first clamping surface 32 towards the second clamping surface 34. Conversely, moving the lever 48 from the closed position to the open position allows the first clamping surface 32 to move away from the second clamping surface 34.

In order to lockout a toggle switch of a circuit breaker, the lockout device 10 of the present invention is secured to the toggle switch. The lockout device 10 is secured to the toggle switch by clamping the toggle switch between the first and second clamping surfaces 32 and 34.

Referring to FIGS. 3A, 3B, and 3C, a method of securing the lockout device 10 to a toggle switch 50 includes placing the toggle switch 50 into the desired position, i.e., either the "on" position or the "off" position. As shown in FIG. 3A, the lever 48 of the lockout device 10 is in the open position. The lockout device 10 is positioned such that the toggle switch 50 is located in the gap 36 formed between the first and second clamping surfaces 32 and 34. As shown in FIG. 3B, the knob 28 of the thumbscrew 22 is manually turned in the first direction to move the second clamping surface 34 towards the first clamping surface 32 until the toggle switch 50 is clamped "finger tight" between the first and second clamping surfaces 32 and 34. As seen in FIG. 3C, the lever 48 is moved from the open position to the closed position. This cam movement rotates the cam member 38 such that the camming surface 46 moves the first clamping surface 32 towards the second clamping surface 34. This movement can greatly enhance the clamping force exerted on the toggle switch 50 by the first and second clamping surface 32 and 34.

Figure 4:
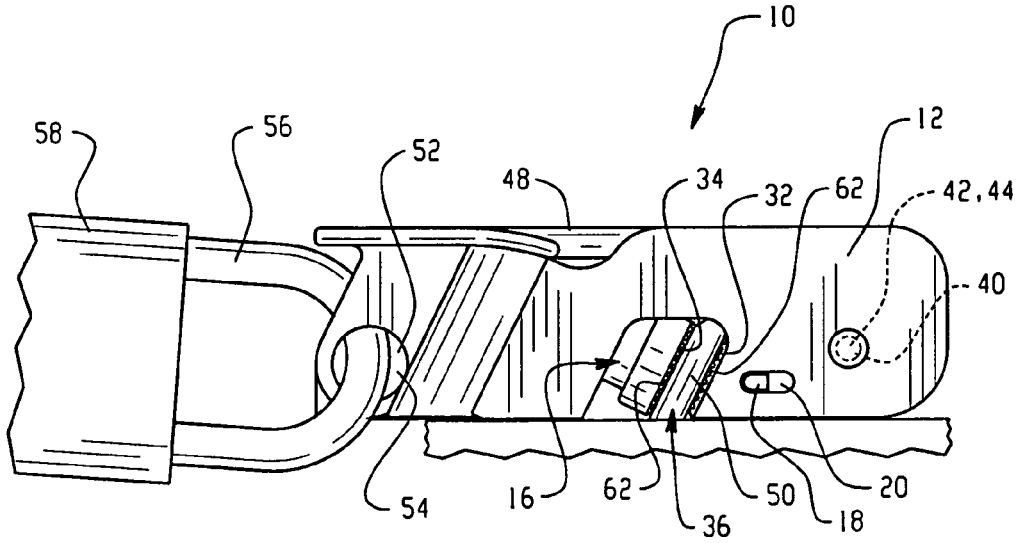
FIG. 4 is a side view of the lockout device of FIG. 1 in the closed position, wherein the toggle switch is clamped between the clamping surfaces of the device and a lock is attached to the device.
Figure 5:
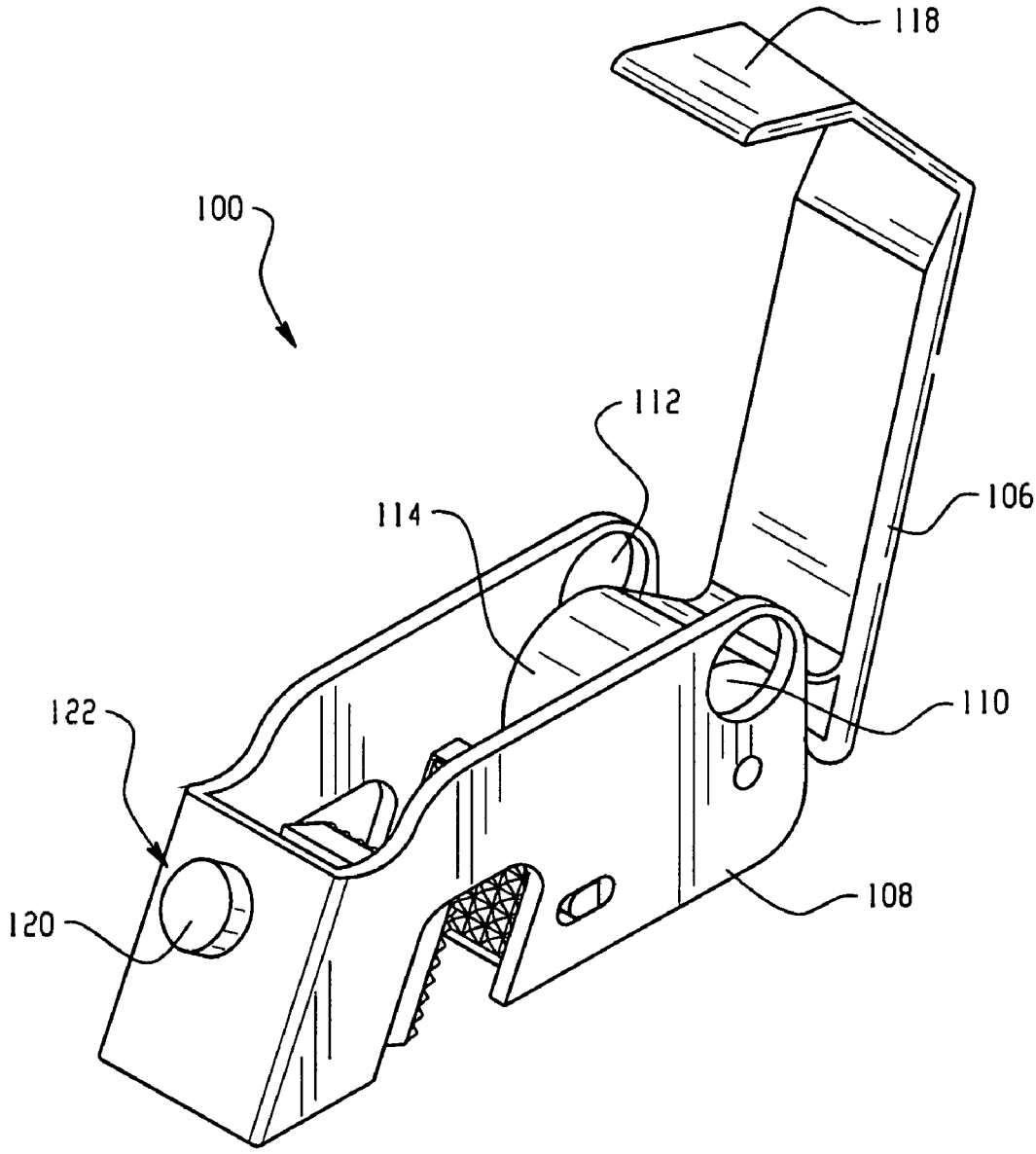
FIG. 5 is a perspective view of another lockout device constructed in accordance with the present invention.

Optionally, the lockout device 10 can be arranged to accept a lock shackle to maintain the lever 48 in a closed position. Referring again to FIG. 1, the body 12 includes a body shackle aperture 52 and the lever 48 includes a lever shackle aperture 54. As best seen in FIG. 3C, when the lever 48 is in the closed position, the body shackle aperture 52 and the lever shackle aperture 54 align and can accommodate a shackle of a lock. As seen in FIG. 4, the shackle 56 of a lock 58 can pass through the aligned apertures 52 and 54 and the lock 58 can be closed and secured such that the lock 58 has to be opened and the shackle 56 removed to allow the lever 48 to move from the closed to the open position.

Referring again to FIG. 4, when the lever 48 is locked in a closed position, a portion 60 of the lever 48 restricts access to the knob 28 of the thumbscrew 22. This arrangement lessens the opportunity for the removal of the lockout device 10 from the toggle switch 50 by an intentional or inadvertent loosening of the thumbscrew 22.

Optionally, the first and the second clamping surfaces 32 and 34 can include a plurality of gripping features or elements. In the embodiment illustrated in FIGS. 1 through 4, the gripping elements are rows of teeth 62. These teeth 62 can enhance the grip of the first and second clamping surfaces 32 and 34 on the toggle switch 50 by "digging in" or "biting in" to the surfaces of the toggle switch 50. Although the gripping features are shown as teeth 62, any feature that enhances the grip of first and second clamping surfaces on a toggle switch are included in this disclosure. For example, placing an elastomeric layer or coating having a relatively high coefficient of friction on first and second clamping surfaces can increase the grip on a toggle switch.

FIGS. 5 through 8 illustrate another exemplary embodiment of the lockout device 100 in accordance with the present invention. This lockout device 100 is similar to the lockout device 10 illustrated in FIGS. 1 through 4, with the exception of the location in which a shackle 102 of a lock 104 is placed on the lockout device 100 to lock the lever 106 in a closed position.

Figure 6:
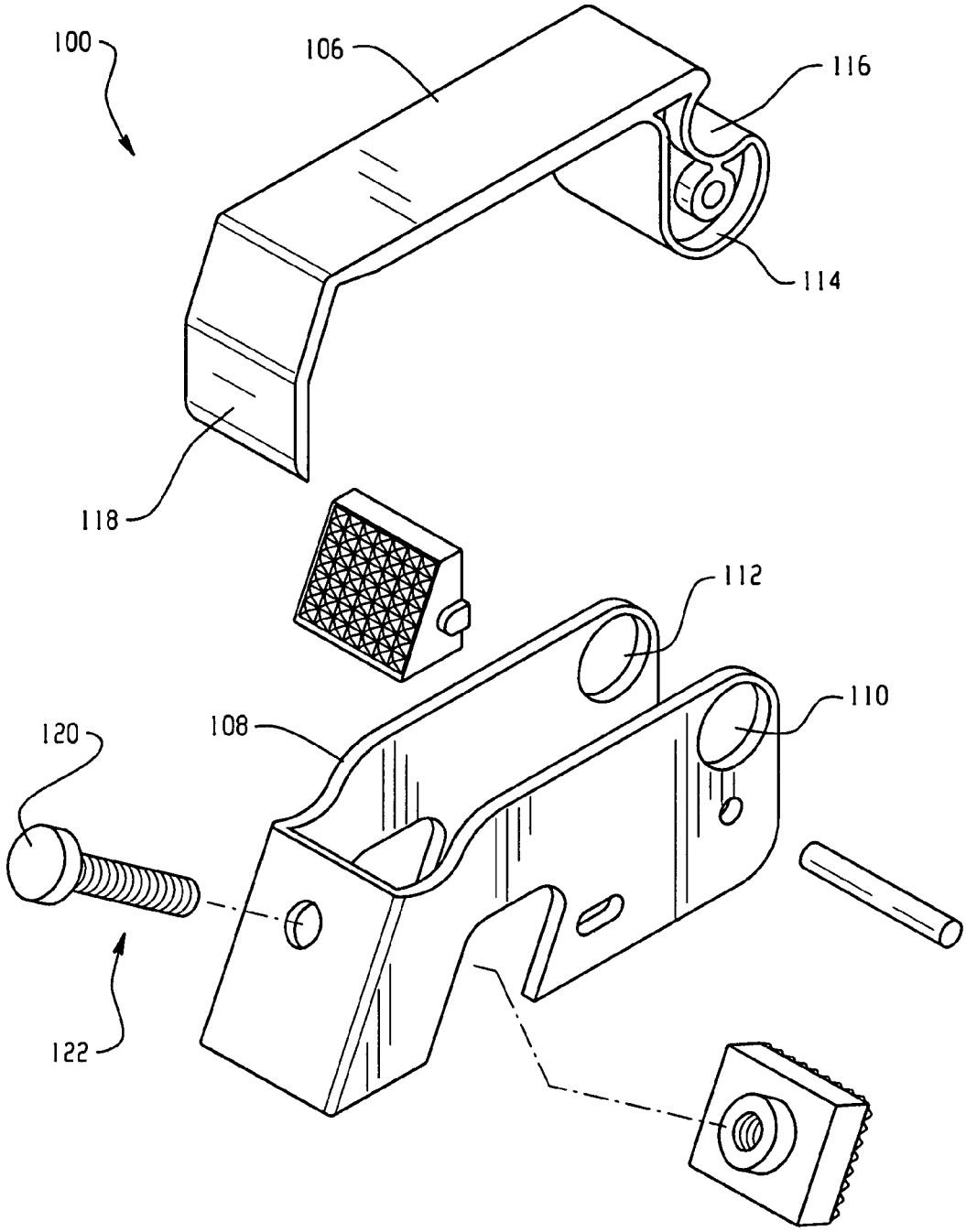
FIG. 6 is an exploded view of the lockout device of FIG. 5.
Figure 7A:
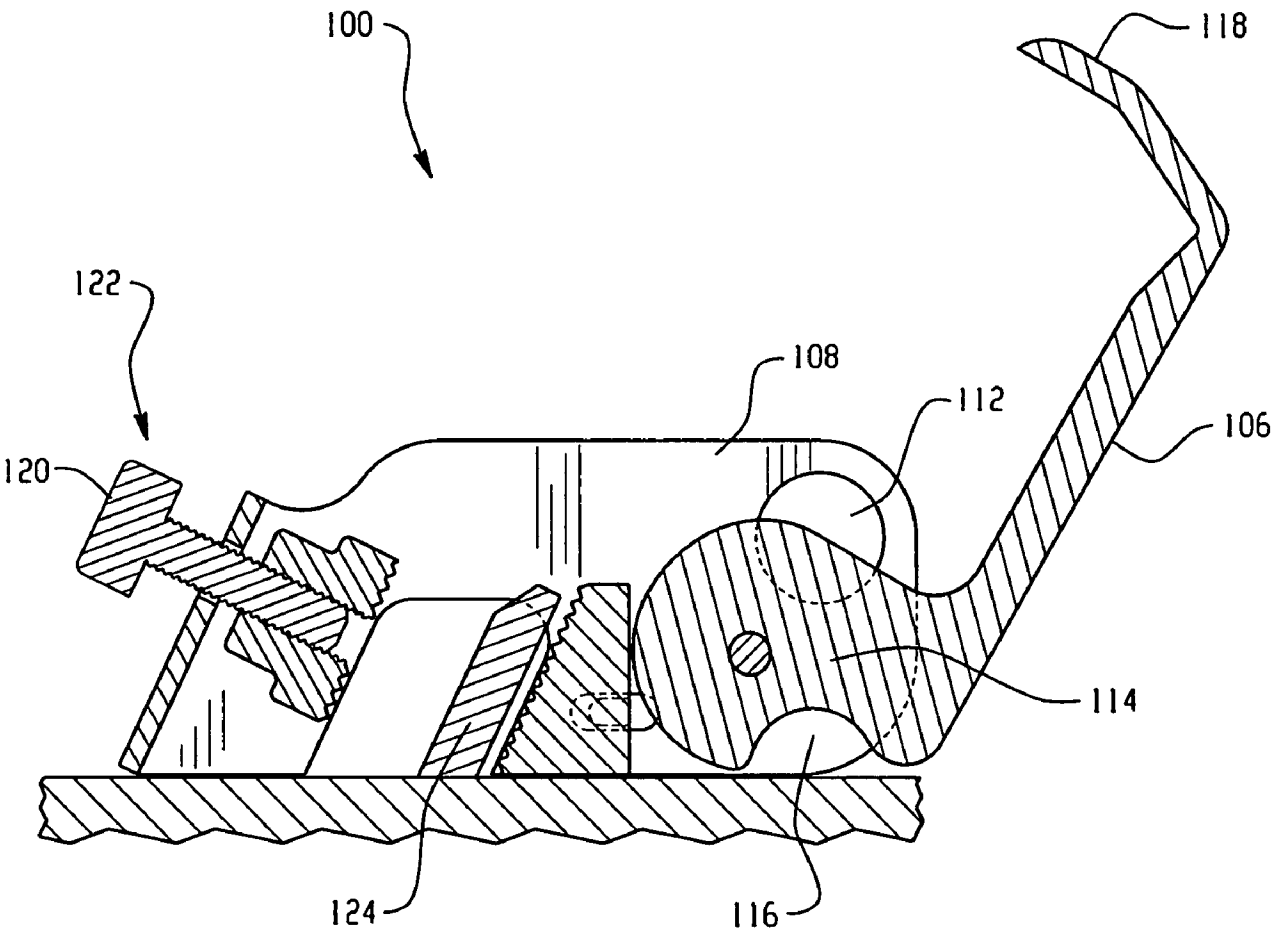
FIG. 7A is a cross-sectional view of the lockout device of FIG. 5 in an open position, wherein a toggle switch is positioned between the clamping surfaces of the device.
Figure 7B:
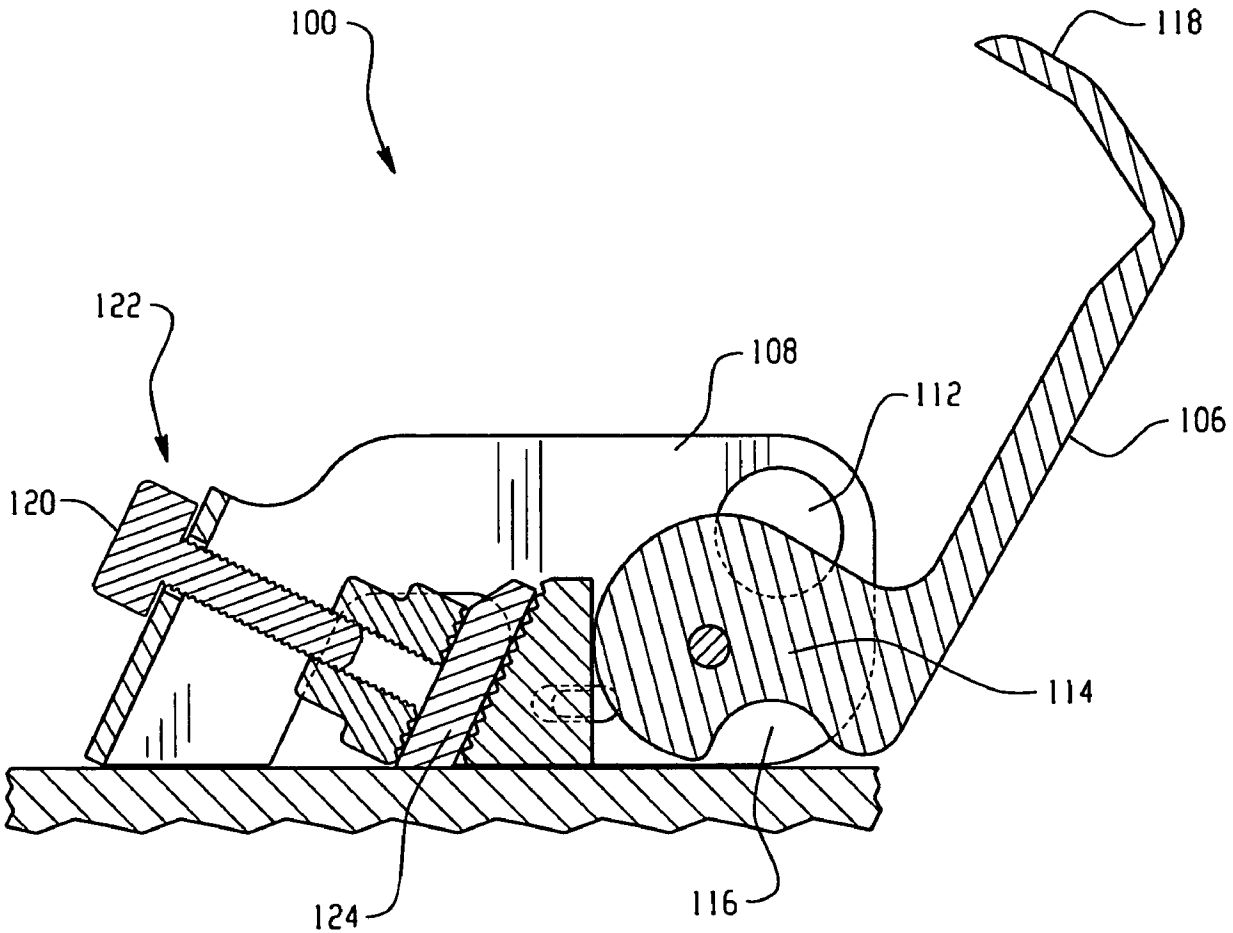
FIG. 7B is a cross-sectional view of the lockout device of FIG. 5 in an open position, wherein the toggle switch is clamped between the clamping surfaces of the device.
Figure 7C:
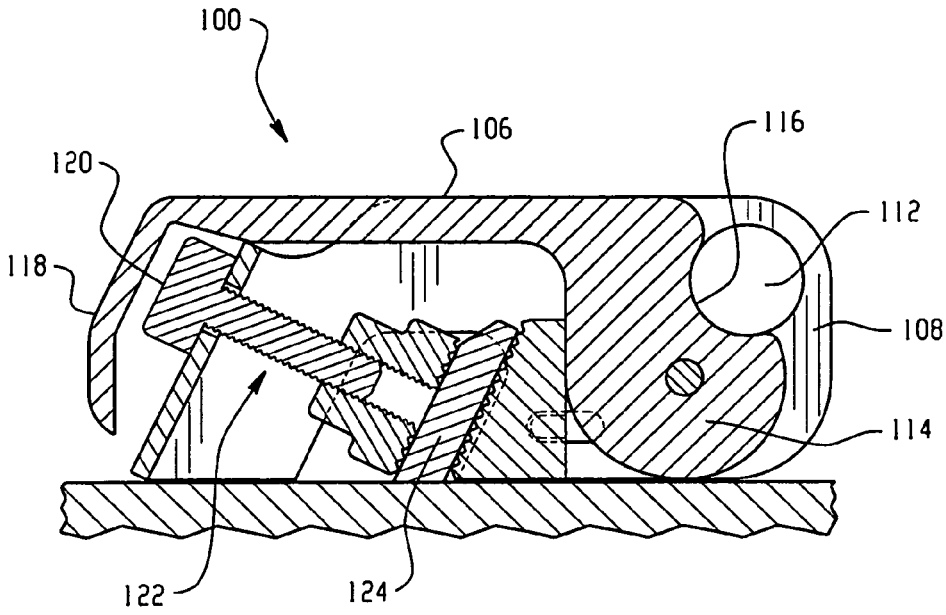
FIG. 7C is a cross-sectional view of the lockout device of FIG. 5 in the closed position, wherein a toggle switch is clamped between the clamping surfaces of the device.
Figure 8:
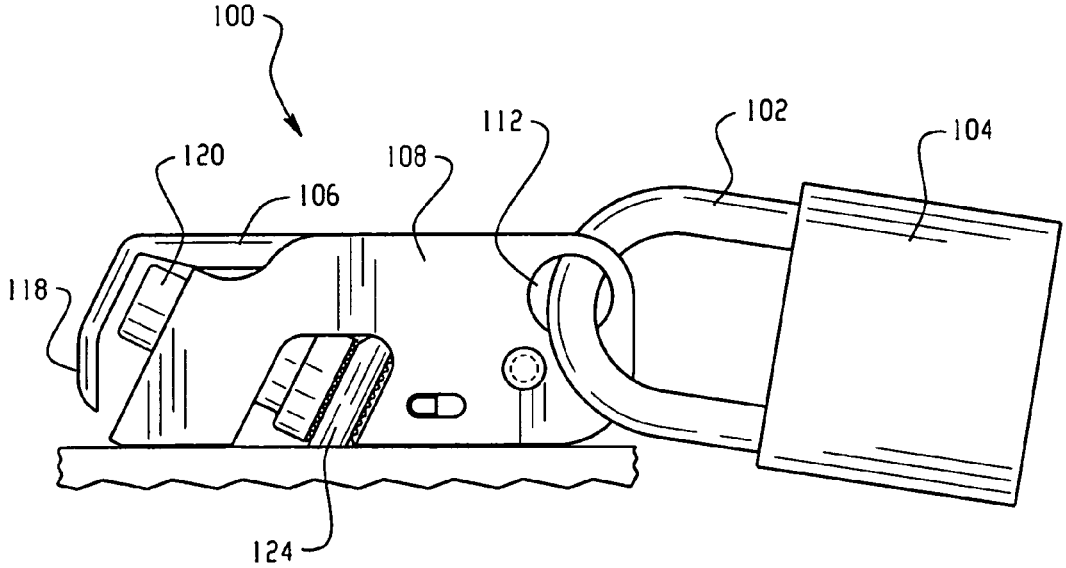
FIG. 8 is a side view of the lockout device of FIG. 5 in the closed position, wherein the toggle switch is clamped between the clamping surfaces of the device and a lock is attached to the device.
Figure 9:
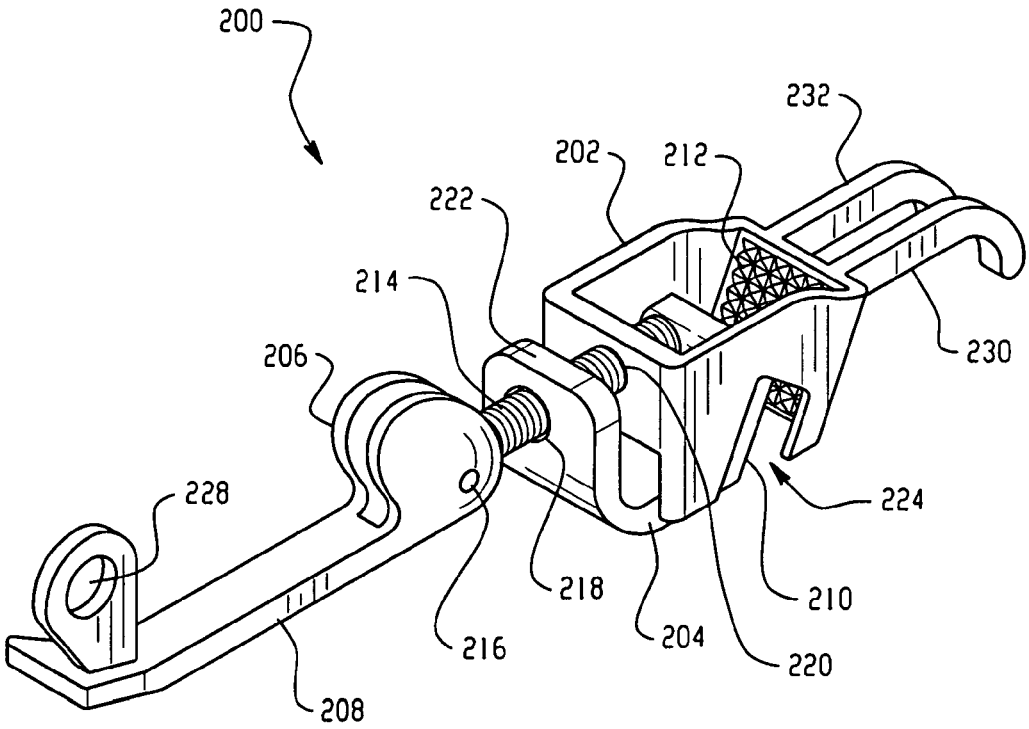
FIG. 9 is a perspective view of yet another lockout device constructed in accordance with the present invention.
Figure 10:
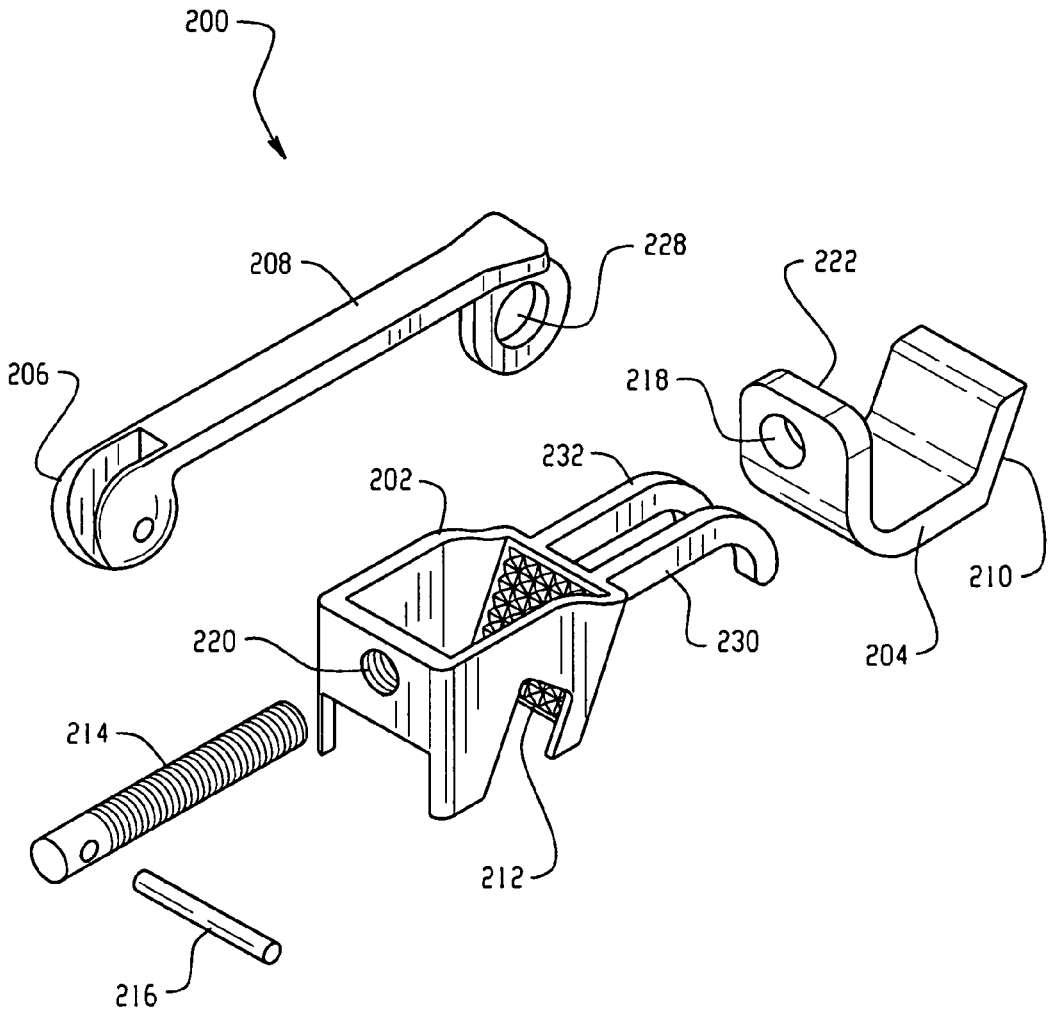
FIG. 10 is an exploded view of the lockout device of FIG. 9.

As best seen in FIG. 6, the body 108 of the lockout device 100 includes a pair of shackle apertures 110 and 112 and the cam member 114 includes a groove 116. When the lever 106 is in the closed position (as best seen in FIG. 7C), the groove 116 of the cam member 114 aligns with the pair of shackle apertures 110 and 112 in the body 108. As shown in FIG. 8, this alignment allows for the shackle 102 of the lock 104 to pass through the pair of shackle apertures 110 and 112. The shackle 102 passes through the apertures 110 and 112 such that the shackle 102 is either in contact with or proximate to the groove 116 in the cam member 114. In this arrangement, the shackle 102 will prevent to the lever 106 from being moved from the closed position to the open position.

As is best seen in FIG. 8, the lever 106 is designed such that when the lever 106 is in the closed position, a portion 118 of the lever 106 is positioned to restrict access to a knob 120 of a thumbscrew 122. Similar to the previous description, this arrangement lessens the opportunity for the removal of the lockout device 100 from a toggle switch 124 by an intentional or inadvertent loosening of the thumbscrew 122.

FIGS. 9 through 12 illustrate yet another exemplary embodiment of a lockout device 200 in accordance with the present invention. This embodiment includes a body 202, a first clamping member 204, a cam 206, and a lever 208 coupled to the cam 206. The first clamping member 204 includes a first clamping surface 210. A second clamping surface 212 is incorporated into the body 202. A threaded adjustment screw 214 couples the first clamping member 204 and the cam 206 to the body 202. The adjustment screw is attached to the cam 206 by a pivot pin 216. The adjustment screw 214 passes through an aperture 218 in the first clamping member 204 and then through a threaded aperture 220 in the body 202. This arrangement positions a portion 222 of the first clamping member 204 between the cam 208 and the body 202. The first clamping surface 210 of the first clamping member 204 is positioned to form a gap 224 between the first clamping surface 210 and the second clamping surface 212.

The threaded adjustment screw 214 is rotated in the threaded aperture 220 in the body 202 to position of the adjustment screw 214 relative to the body 202. Through the fixed attachment of the adjustment screw 214 to the cam 206, the position of the attachment screw 214 relative to the body 202 also determines the position of the cam 206 relative to the body 202. As the adjustment screw 214 is rotated or turned in a first direction, the cam 206 moves closer to the body 202 and as the adjustment screw 214 is rotated in a second direction the cam 206 moves away from the body 202. One method of rotating the adjustment screw 214 is to rotate the attached lever 208 when the lever 208 is in the open position as shown in FIG. 11A.

The first clamping member 204 is positioned on the attachment screw 214 between the body 202 and the cam 206. The inner diameter of the aperture 218 of the first clamping member 204 is larger than the outer diameter of the adjustment screw 214. This relationship allows the first clamping member 204 to slide along the adjustment screw 214 between the cam 206 and the body 202. Thus, as the cam 206 moves relative to the body 202, the potential positions of the first clamping member 204 change as well. The position of the cam 206 with respect to the body 202 determines the maximum size of the gap 224 between the first clamping surface 210 and the second clamping surface 212. As seen in FIG. 11A, when the cam 206 is positioned farther from the body 202, the gap 224 between the first and second clamping surfaces 210 and 212 is relatively large. As seen in FIG. 11B, when the cam 206 is positioned nearer to the body 202, the gap 224 between the first and second clamping surfaces 210 and 212 is relatively small. This flexibility in the positioning of the first clamping surface 210 with respect to the second clamping surfaces 212 allows the lockout device 200 to accommodate a variety of sized toggle switches.

The lever 208 can be moved from an open position to a closed position. FIGS. 11A and 11B illustrate the lever 208 in the open position and FIGS. 11C and 12 illustrate the lever 208 in the closed position. When the lever 208 is in the open position, the lever 208 can be used to rotate or turn the adjustment screw 214 to change the position of the cam 206 relative to the body 202. When the lever 208 is in the closed position, the lever 208 cannot be used to rotate or turn the adjustment screw 214 to change the position of the cam 206 with respect to the body 202.

Figure 11A:
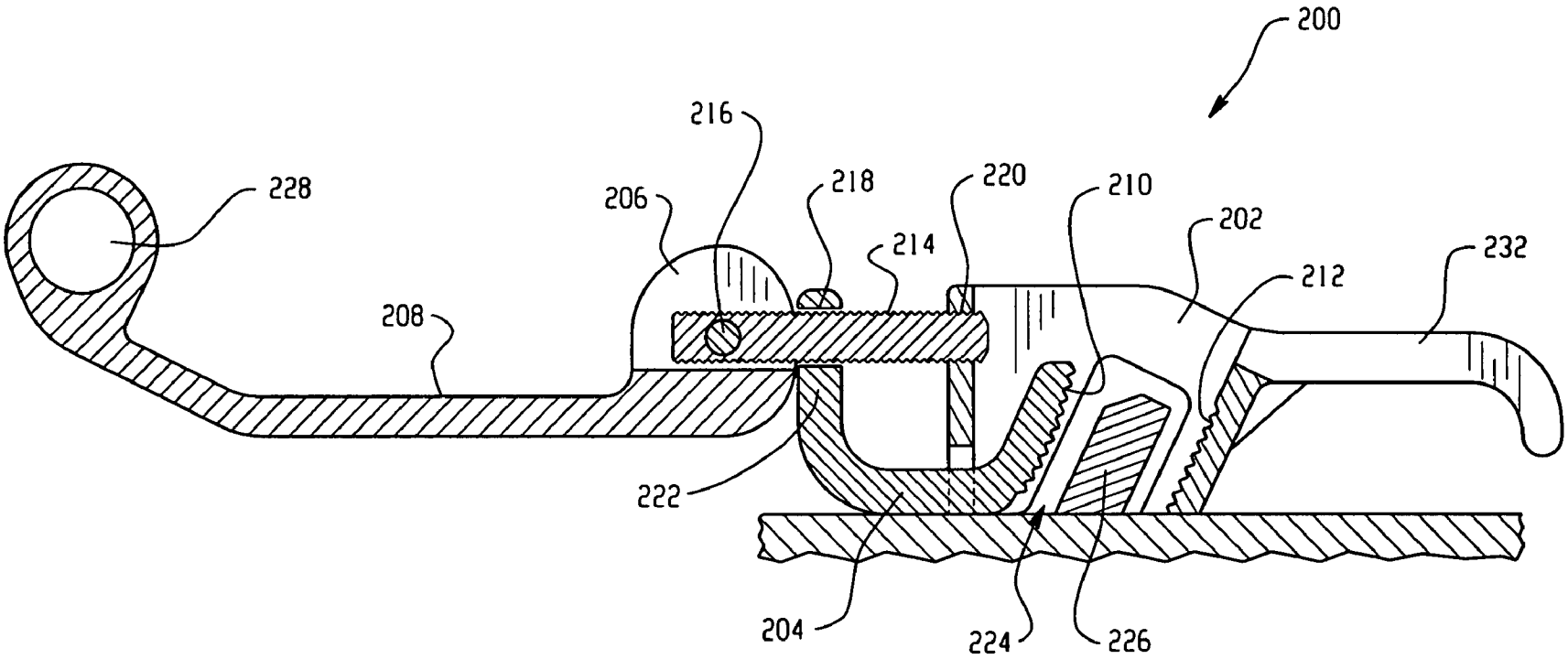
FIG. 11A is a cross-sectional view of the lockout device of FIG. 9 in an open position, wherein a toggle switch is positioned between the clamping surfaces of the device.
Figure 11B:
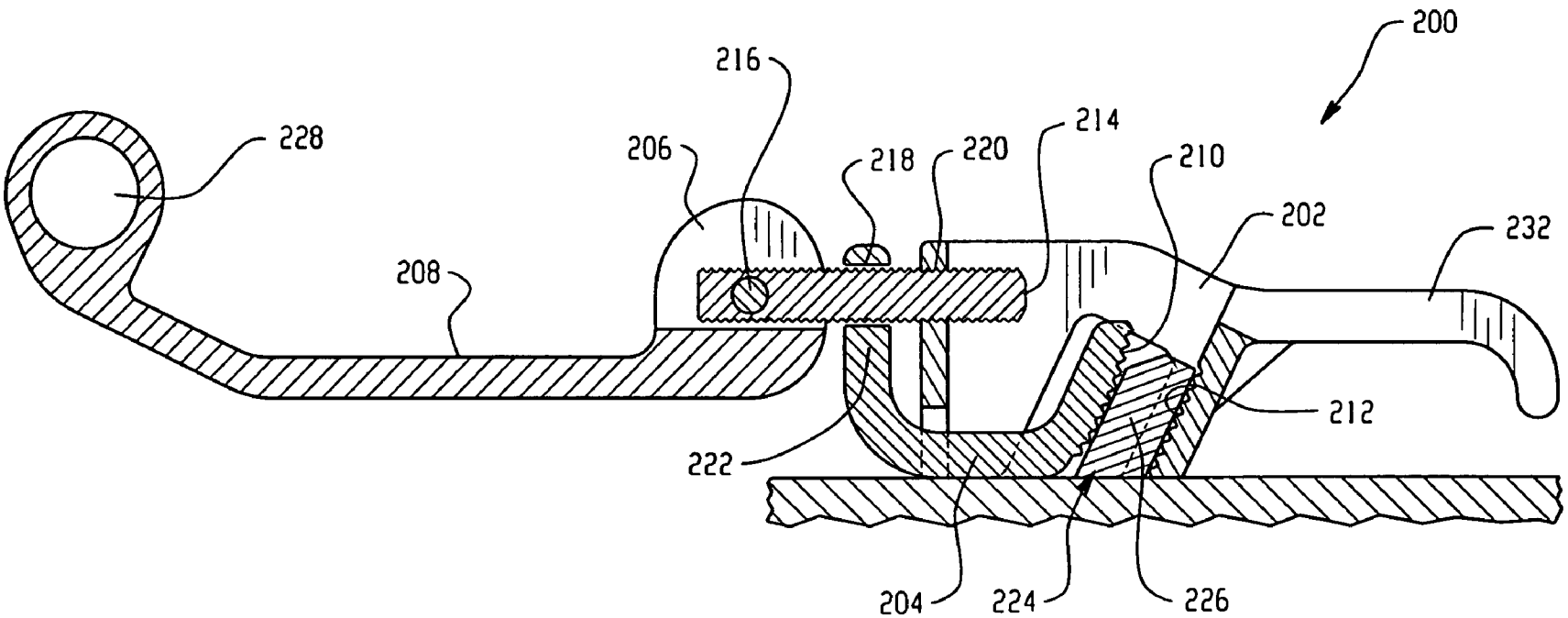
FIG. 11B is a cross-sectional view of the lockout device of FIG. 9 in an open position, wherein the toggle switch is clamped between the clamping surfaces of the device.
Figure 11C:
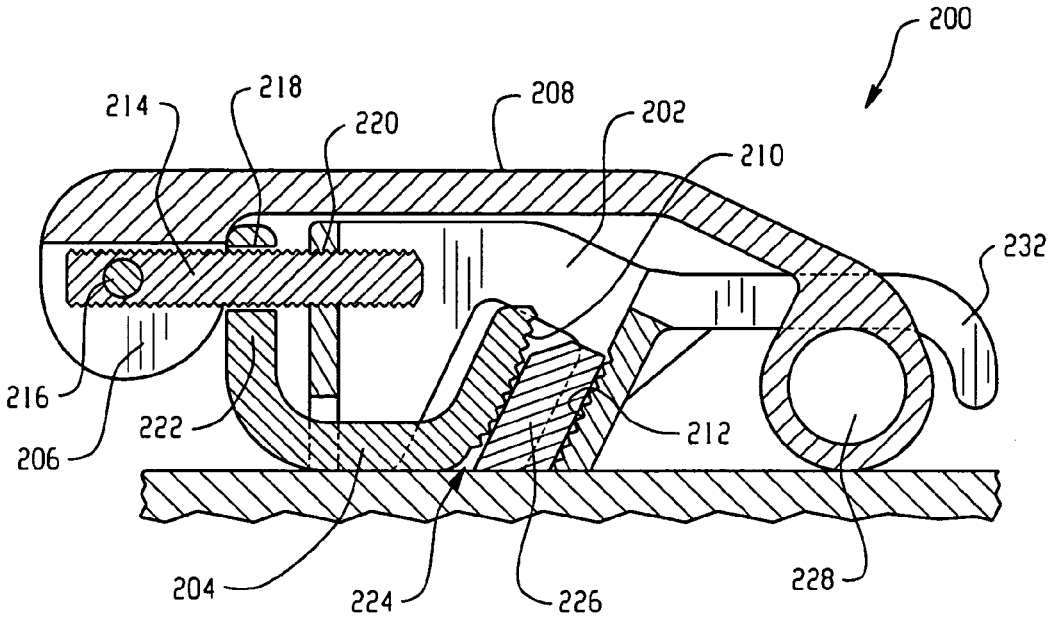
FIG. 11C is a cross-sectional view of the lockout device of FIG. 9 in the closed position, wherein a toggle switch is clamped between the clamping surfaces of the device.
Figure 12:
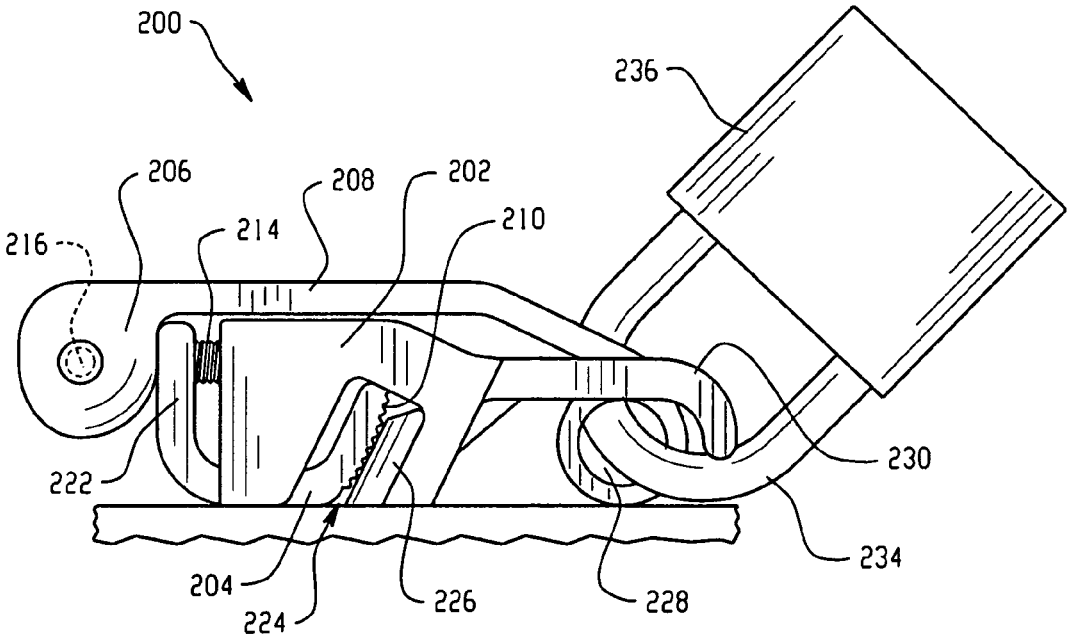
FIG. 12 is a side view of the lockout device of FIG. 9 in the closed position, wherein the toggle switch is clamped between the clamping surfaces of the device and a lock is attached to the device.
Figure 13:
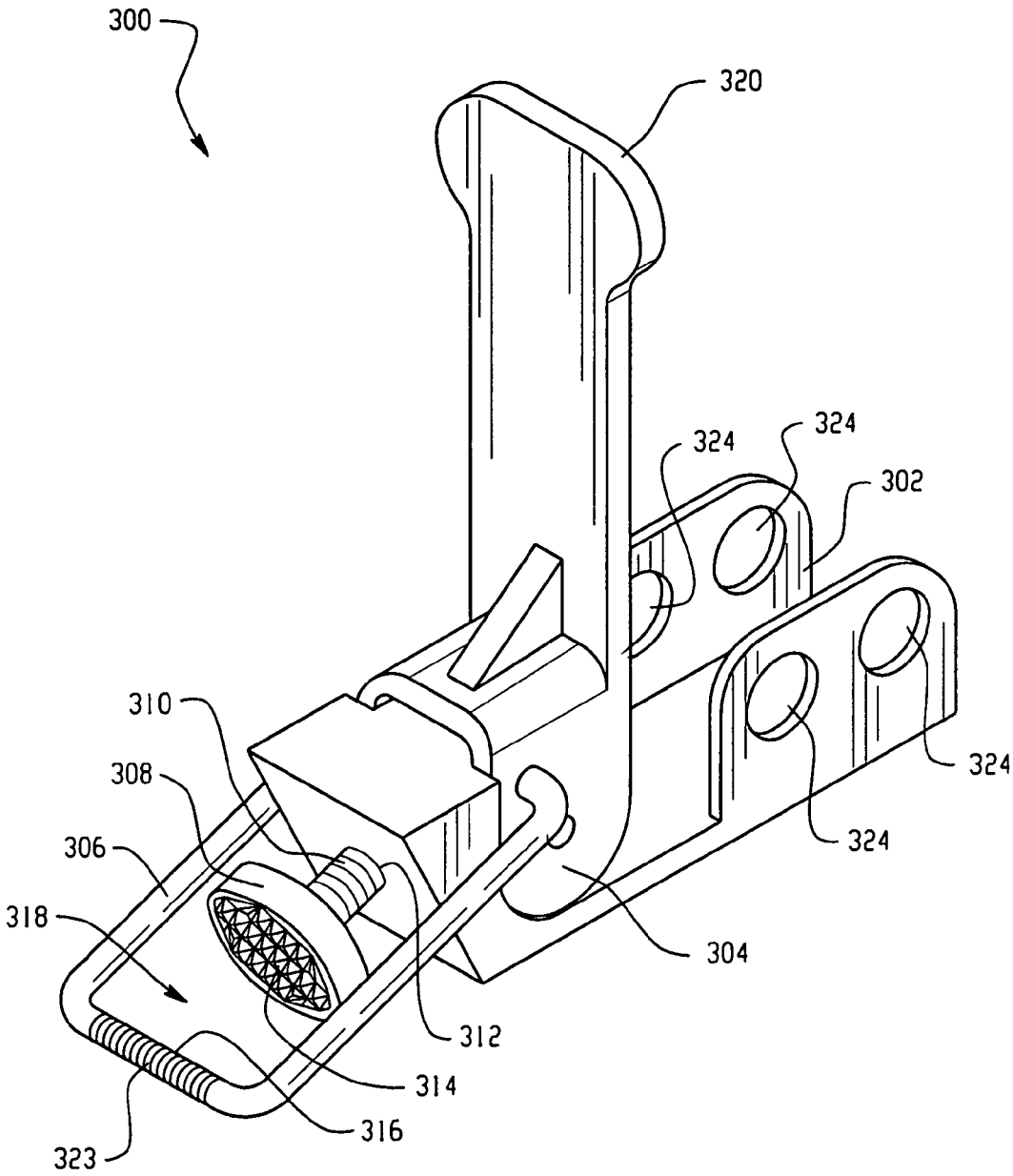
FIG. 13 is a perspective view of yet another lockout device constructed in accordance with the present invention.
Figure 14:
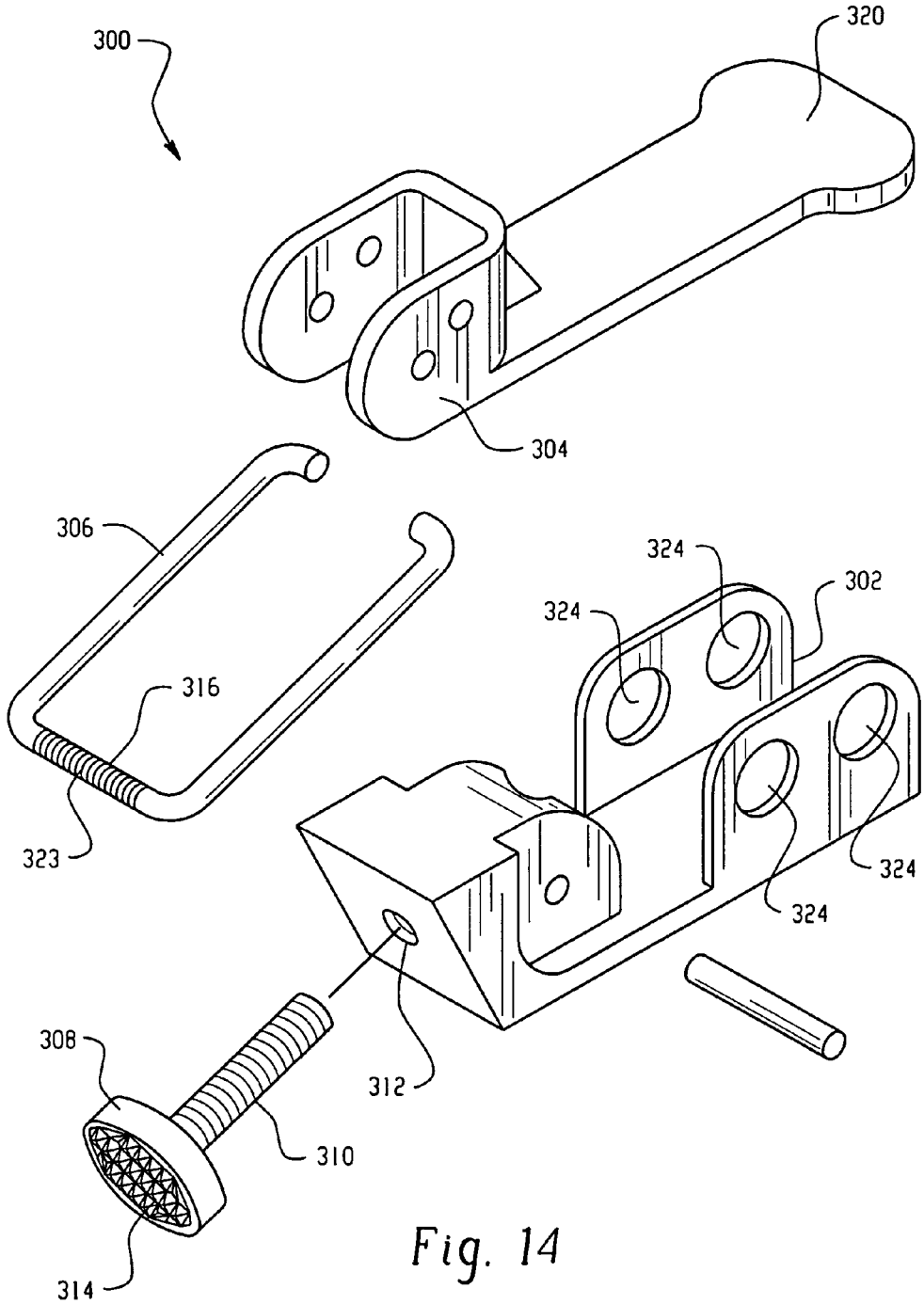
FIG. 14 is an exploded view of the lockout device of FIG. 13.

A method of locking out a circuit breaker using the lockout device 200 includes placing the lever 208 in the open position, rotating the lever 208 to move the cam 206 away from the body 202, and positioning a toggle switch 226 between the first and second clamping surfaces 210 and 212, as shown in FIG. 11A. The lever 208 is then rotated (to rotate the adjustment screw 214) to move the cam 206, and thus the first clamping surface 210 towards the toggle switch 226. The lever 208 continues to be rotated until the toggle switch 226 is clamped between the first clamping surface 210 and the second clamping surface 212, as seen in FIG. 11B. The lever 208 is then moved from the open position to the closed position, as seen in FIG. 11C. When the lever 208 is moved from the open position to the closed position, the cam 206 pivots and, when in contact with the first clamping member 204, increases the clamping force on the toggle switch 226.

The lever 208 includes an aperture 228 and the body 202 includes a pair of rails 230 and 232, which extending from one end of the body 202. When the lever 208 is in the closed position, the aperture 228 is positioned below and between the rails 230 and 232, as seen in FIG. 11C. In this position, a shackle 234 of a lock 236 can be passed through the aperture 228. Once the lock 236 is secured, the lever 208 cannot be moved from the closed position to the open position without unlocking the lock 236 and removing the shackle 234 from the aperture 228. The rails 230 and 232 are sized such that the aperture 228 is positioned under and between the rails 230 and 232 when the lever 208 is in the closed position regardless of whether the first and second clamping surfaces 210 and 212 are positioned relatively close together or relatively far apart.

FIGS. 13 through 16 illustrate yet another exemplary embodiment of a lockout device 300 in accordance with the present invention. The exemplary embodiment includes a body 302, a cam 304 hinged to the body 302, a U-shaped bar 306 coupled to the body 302, and a first clamping member 308 coupled to the body 302. The first clamping member 308 is coupled to the body 302 by a threaded rod 310. The threaded rod 310 is attached to the first clamping member 308 on a first end and a second end passes through a threaded aperture 312 in the body 302. The position of the first clamping member 308 relative to the body 302 is controlled by rotation of the threaded rod 310. When the rod 310 is rotated in a first direction, the first clamping member 308 moves towards the body 302 and when the rod 310 is rotated in a second direction, the first clamping member 308 moves away from the body 302. The first clamping member 308 is coupled to the rod 310 such that the rod 310 can be rotated by rotating the first clamping member 308.

The first clamping member 308 includes a first clamping surface 314. The U-shaped bar 306 includes a second clamping surface 316. The first and second clamping surfaces 314 and 316 are positioned to form a gap 318 between the surfaces 314 and 316. As the rod 310 is rotated to move the first clamping member 308 towards the body 302, the gap 318 increases. As the rod 310 is rotated to move the first clamping member 308 away from the body 302, the gap 318 decreases.

Figure 15A:
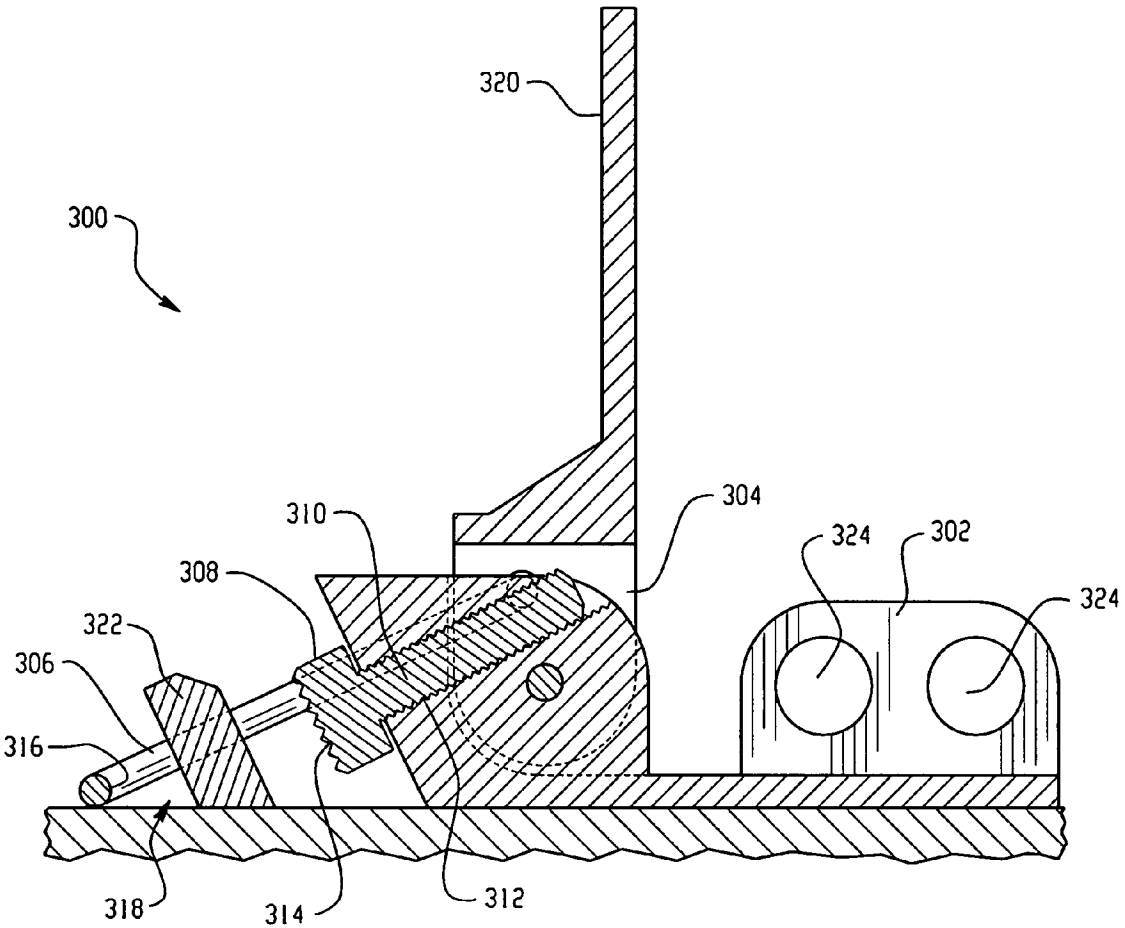
FIG. 15A is a cross-sectional view of the lockout device of FIG. 13 in an open position, wherein a toggle switch is positioned between the clamping surfaces of the device.
Figure 15B:
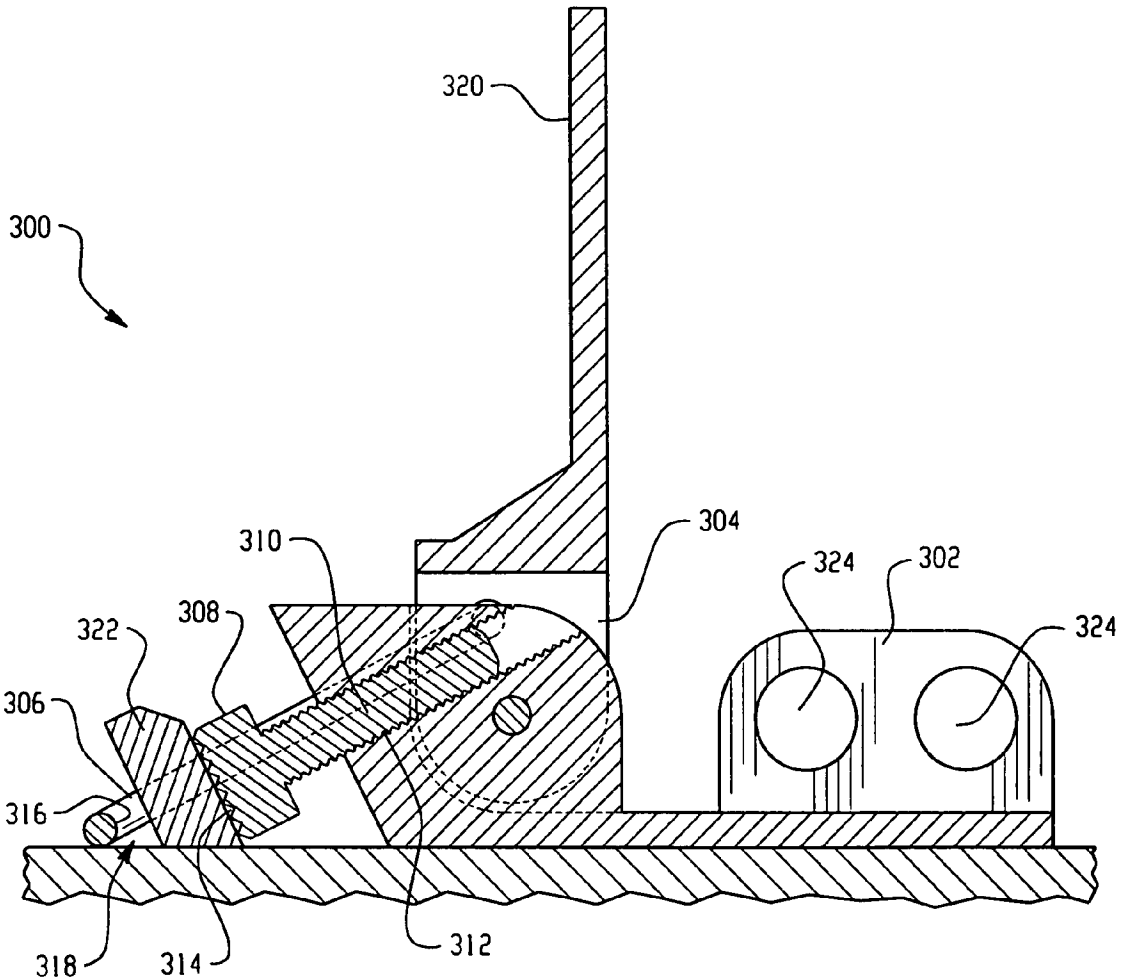
FIG. 15B is a cross-sectional view of the lockout device of FIG. 13 in an open position, wherein the toggle switch is clamped between the clamping surfaces of the device.
Figure 15C:
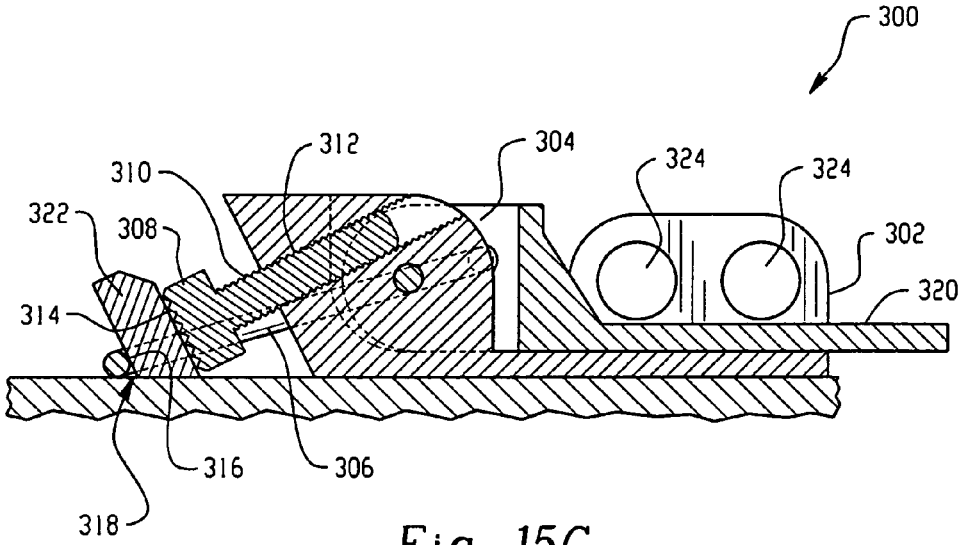
FIG. 15C is a cross-sectional view of the lockout device of FIG. 13 in the closed position, wherein a toggle switch is clamped between the clamping surfaces of the device.
Figure 16:
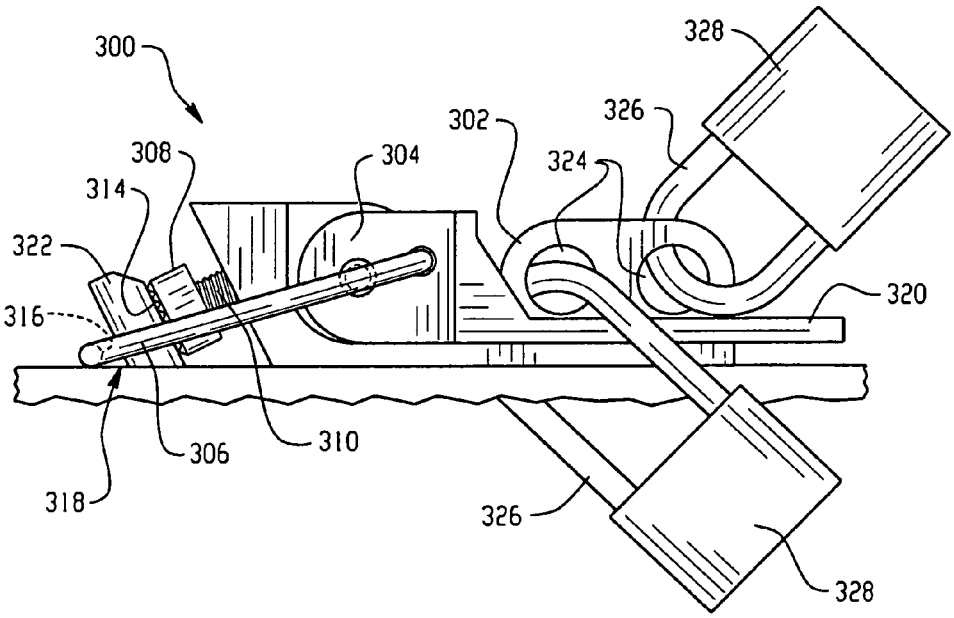
FIG. 16 is a side view of the lockout device of FIG. 13 in the closed position, wherein the toggle switch is clamped between the clamping surfaces of the device and a pair of locks are attached to the device.

A lever 320 is coupled to the cam 304. The lever 320 includes an open position, as shown in FIGS. 15A and 15B, and a closed position, as shown in FIGS. 15C and 16. As the lever 320 moves from the open position to the closed position, the cam 304 rotates and draws the second clamping surface 316 of the U-shaped bar 306 closer to the first clamping surface 314.

Similar to other embodiments, a toggle switch 322 can be placed in the gap 318 between the first and second clamping surfaces 314 and 316 with the lever 320 in an open position, as seen in FIG. 15A. The first clamping member 308 can be rotated (thus rotating the threaded rod 310) until the toggle switch 322 is clamped between the first clamping surface 314 and the second clamping surface 316, as seen in FIG. 15B. The lever 320 can be moved from the open position to the closed position to increase the clamping force on the toggle switch 322, as seen in FIG. 15C.

Alternatively, the first clamping member 308 can be adjusted to leave the gap 318 between the first and second clamping surfaces 314 and 316 such that it is approximately the size of a toggle switch 322. The toggle switch 322 can then be placed in the gap 318 and the lever 320 moved from the open to the closed position. This movement draws the second clamping surface 316 towards the first clamping surface 314 and clamps the toggle switch 322 between the first and second clamping surfaces 314 and 316.

The second clamping surface 316 of the U-shaped bar 306 can include gripping features or elements. For example, ridges 323 can be formed on the second clamping surface 316 to enhance the grip of the second clamping surface 316 on the toggle switch 322 when the toggle switch 322 is clamped between the first and second clamping surfaces 314 and 316.

The body 302 includes four apertures 324 sized to accommodate a shackle 326 of a lock 328. The lever 320 has a low profile such that when the lever 320 is in the closed position, as seen in FIGS. 15C and 16, the lever 320 is positioned below the apertures 324 and does not interfere with the apertures 324. When in the closed position, a shackle 326 can be placed through any of the four apertures 324 to lock the lockout device 300 in a closed position. Due to the arrangement of the apertures 324, a second (as seen in FIG. 16), third, and fourth shackle 326 may be passed through apertures 324. The arrangement of multiple apertures 324 can be utilized for situations where taking the lockout device 300 off a circuit servicing a critical machine needs the approval of multiple decision makers. In this situation, the lockout device 300 cannot be removed from the toggle switch 322, such that the state of the toggle switch 322 can be changed, until each decision maker removes a lock 328 from the lockout device 300.

While various aspects of the invention are described and illustrated herein as embodied in combination in the exemplary embodiments, these various aspects may be realized in many alternative embodiments not shown, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however; such values and ranges are not to be construed in a limiting sense and are intended to be critical values or ranges only if so expressly stated.

We claim:

1. A lockout device for a toggle switch comprising:

a. a body;

b. a first clamping surface moveably coupled to the body;

c. a second clamping surface coupled to the body; and d. a cam coupled to the body;

e. wherein when the cam is rotated in a first direction about a central axis, the cam moves the first clamping surface in a direction nonparallel to the central axis and towards the second clamping surface.

2. The device of claim 1 wherein the cam is rotateable between an open position and a closed position;

wherein rotating the cam in the first direction moves the cam towards the closed position and rotating the cam in a second direction moves the cam towards the open position.

3. The device of claim 2 wherein the body further defines at least one aperture sized to accommodate a first lock shackle.

4. The device of claim 3 wherein when the cam is in the closed position, the first lock shackle can be inserted into a first of the at least one apertures to prevent the cam from rotating to the open position.

5. The device of claim 4 wherein when the cam is in the closed position, a second lock shackle can be inserted into a second of the at least one apertures to prevent the cam from rotating to the open position.

6. The device of claim 2 further comprising a lever coupled to the cam;

wherein movement of the lever rotates the cam with respect to the body.

7. The device of claim 6 wherein the lever defines at least one aperture sized to accommodate a first lock shackle;

wherein when the cam is in the closed position, the first lock shackle can be inserted into a first of the at least one apertures to fix the position of the cam with respect to the body.

8. The device of claim 7 wherein when the cam is in the closed position, a second lock shackle can be inserted into a second of the at least one apertures to fix the position of the cam with respect to the body.

9. The device of claim 6 wherein the second clamping surface is moveably coupled to the body and an adjustment mechanism is coupled to the second clamping surface to adjust the position of the second clamping surface with respect to the first clamping surface; further wherein when the cam is in the closed position, a portion of the lever is positioned proximate to the adjustment mechanism such that the adjustment mechanism cannot be manipulated to adjust a position of the second clamping surface with respect to the first clamping surface.

10. The device of claim 1 wherein the second clamping surface is moveably coupled to the body.

11. The device of claim 10 further comprising an adjustment mechanism coupled to the second clamping surface;

wherein the adjustment mechanism adjusts the position of the second clamping surface with respect to the first clamping surface.

12. The device of claim 11 wherein the adjustment mechanism comprises:

a. a hole defined by the body; and b. a threaded rod positioned in the hole and coupled to the second clamping surface;

wherein when the rod is rotated in a third direction, the second clamping surface moves towards the first clamping surface and when the rod is rotated in a fourth direction, the second clamping surface moves away from the first clamping surface.

13. The device of claim 1 wherein at least one of the first clamping surface and the second clamping surface includes a plurality of gripping elements.

14. The device of claim 13 wherein the plurality of gripping elements are teeth.

15. The device of claim 1 wherein at least one of the first clamping surface and the second clamping surface includes an elastomeric layer.

16. The device of claim 1 wherein the first clamping surface and the second clamping surfaces are arranged to be approximately parallel.

17. The device of claim 1 wherein the second clamping surface is a bar hinged to the body.

18. The device of claim 17 wherein the bar includes gripping elements.

19. A method of securing a circuit breaker toggle switch comprising:

a. placing the circuit breaker toggle switch in a desired position;

b. positioning a circuit breaker lockout device such that the circuit breaker toggle switch is located between a first clamping surface and a second clamping surface of the device;

c. adjusting the circuit breaker lockout device such that the first clamping surface and the second clamping surface are positioned proximate to the circuit breaker toggle switch; and d. rotating a cam about a central axis to move the first clamping surface in a direction nonparallel with the central axis to clamp the toggle switch between the first clamping surface and the second clamping surface.

20. The method of claim 19 further comprising placing a first lock shackle through a first aperture defined in a body of the circuit breaker lockout device.

21. The method of claim 20 further comprising placing a second lock shackle through a second aperture defined in the body of the circuit breaker lockout device.

22. The method of claim 19 further comprising placing a first lock shackle through a first aperture defined in a handle coupled to the cam of the circuit breaker lockout device.

23. The method of claim 22 further comprising placing a second lock shackle through a second aperture defined in a lever coupled to the cam of the circuit breaker lockout device.

24. A lockout device comprising:

a. a body defining a first aperture;

b. a first clamping member moveably coupled to the body and including a first clamping surface;

c. a second clamping member movably coupled to the body, including a second clamping surface, and defining a threaded aperture;

d. an adjustment mechanism for moving the second clamping member with respect to the body, comprising:

i. a threaded rod including:

1. a first end passing through the first aperture and at least partially located in the threaded aperture; and 2. a second end; and ii. a knob coupled to the second end;

e. a pivot pin; and f. a cam assembly rotateably coupled to the body by the pivot pin and including a lever;

wherein the first clamping surface and the second clamping surface define a gap for accommodating a toggle switch.

25. The lockout device of claim 24 wherein when the knob is rotated in a first direction, the second clamping surface moves towards the first clamping surface and when the knob is rotated in a second direction the second clamping surface moves away from the first clamping surface.

26. The lockout device of claim 24 wherein, when the cam assembly is rotated in a first direction, the cam assembly moves the first clamping surface towards the second clamping surface.

27. The lockout device of claim 24 wherein the body further includes a first shackle aperture and the lever includes a second shackle aperture.

28. The lockout device of claim 27 wherein the lever moves the device between an open and a closed position.

29. The lockout device of claim 28 wherein when the device is in the closed position, a shackle of a lock can pass through the first shackle aperture and the second shackle aperture and fix the position of the lever with respect to the body.

30. The lockout device of claim 24 wherein the body further defines a first slot and a second slot and the first clamping member further comprises a first tab positioned in the first slot and a second tab positioned in the second slot.

31. A lockout device for a toggle switch comprising:

a. a body;

b. a first clamping surface moveably coupled to the body;

c. a second clamping surface coupled to the body; and d. a cam rotateably coupled to the body;

wherein when the cam is rotated in a first direction, the cam moves the first clamping surface towards the second clamping surface with the toggle switch between the first clamping surface and the second clamping surface;

further wherein the second clamping surface is moveably coupled to the body.

* * * * *